United States Patent [19]

Winston

[11] Patent Number: 4,966,365

[45] Date of Patent: Oct. 30, 1990

[54] BODY EXERCISE DEVICE

[76] Inventor: Edith Winston, 135 Hazelwood Dr., Jericho, N.Y. 11753

[21] Appl. No.: 390,224

[22] Filed: Aug. 7, 1989

Related U.S. Application Data

[63] Continuation of Ser. No. 221,036, Jul. 18, 1988, abandoned.

[51] Int. Cl.[5] ..... A63B 21/065

[52] U.S. Cl. ..... 272/119

[58] Field of Search ..... 272/119, 117, 123, 143, 272/122

[56] References Cited

U.S. PATENT DOCUMENTS

| | | | |
|---|---|---|---|
| 3,334,898 | 8/1967 | McCrory et al. | 272/119 |
| 3,427,020 | 2/1969 | Montour et al. | 272/119 |
| 3,924,851 | 12/1975 | Winston | 272/119 X |
| 4,303,239 | 12/1981 | Walsh, Jr. | 272/119 |
| 4,322,072 | 3/1982 | White | 272/119 |
| 4,396,190 | 8/1983 | Wilkerson | 272/119 |
| 4,623,143 | 11/1986 | Woellenweber | 272/119 |

FOREIGN PATENT DOCUMENTS

| | | | |
|---|---|---|---|
| 1568081 | 5/1980 | United Kingdom | 272/119 |

OTHER PUBLICATIONS

Advertisement for Elmer's Therapeutic Weights, 1985.

*Primary Examiner*—Robert Bahr

[57] ABSTRACT

A fabric body of a rectangular shape for encircling a user's limb. The fabric body includes a plurality of side-by-side compartments each receiving a packet of particulate, and a foam panel occupying an interposed position between the body and the user's limb. The particulate conforms to the shape of the user's limb, and in conjunction with the foam panel contributes to comfort during the wearing of the body.

1 Claim, 3 Drawing Sheets

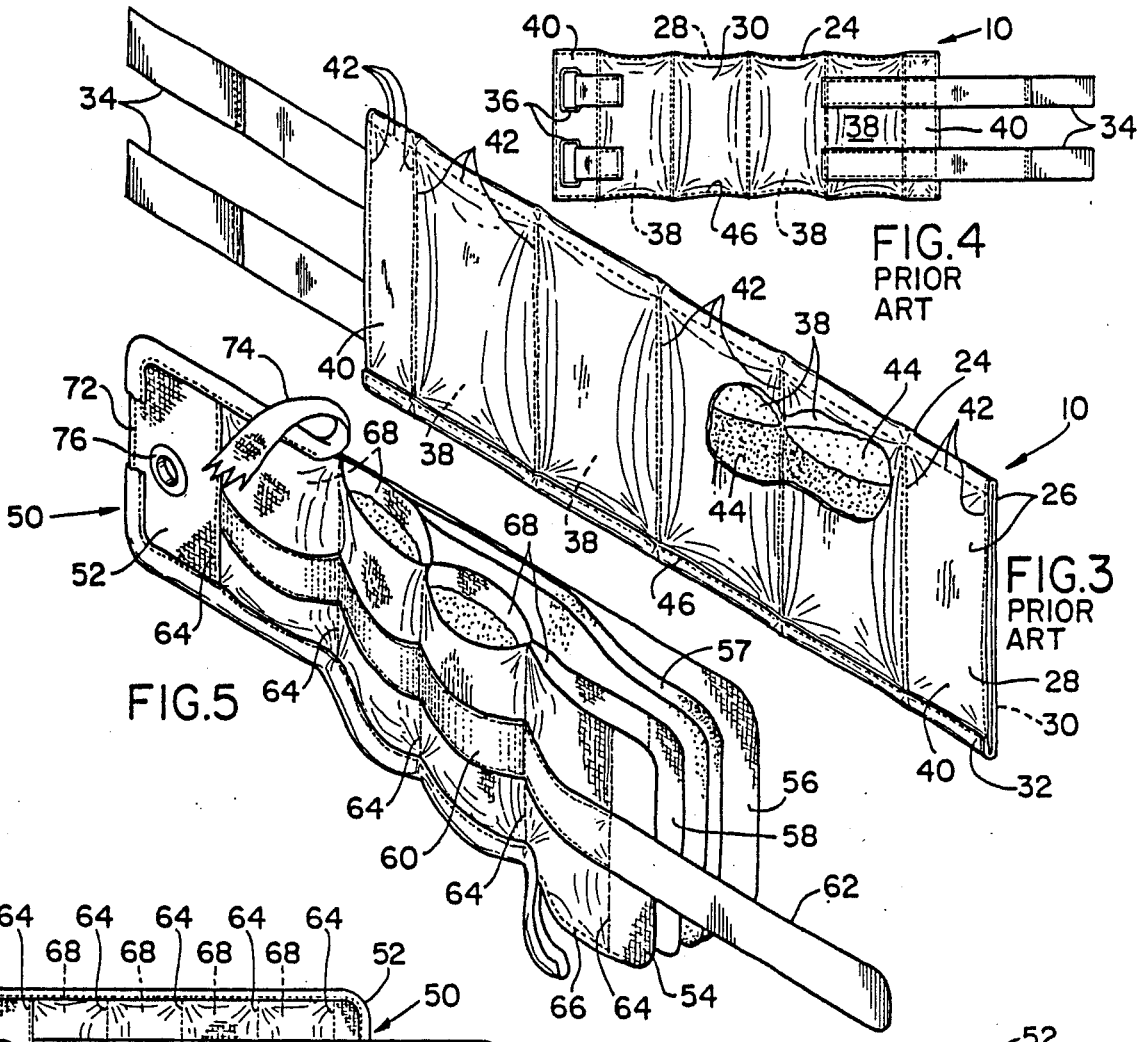
FIG.4 PRIOR ART
FIG.3 PRIOR ART
FIG.5
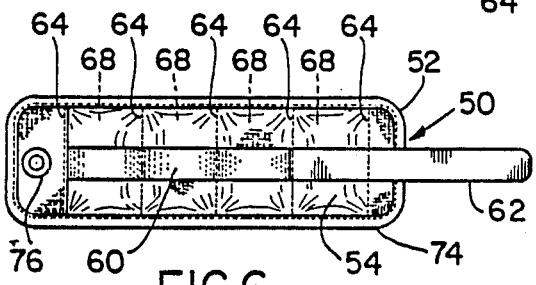
FIG.6
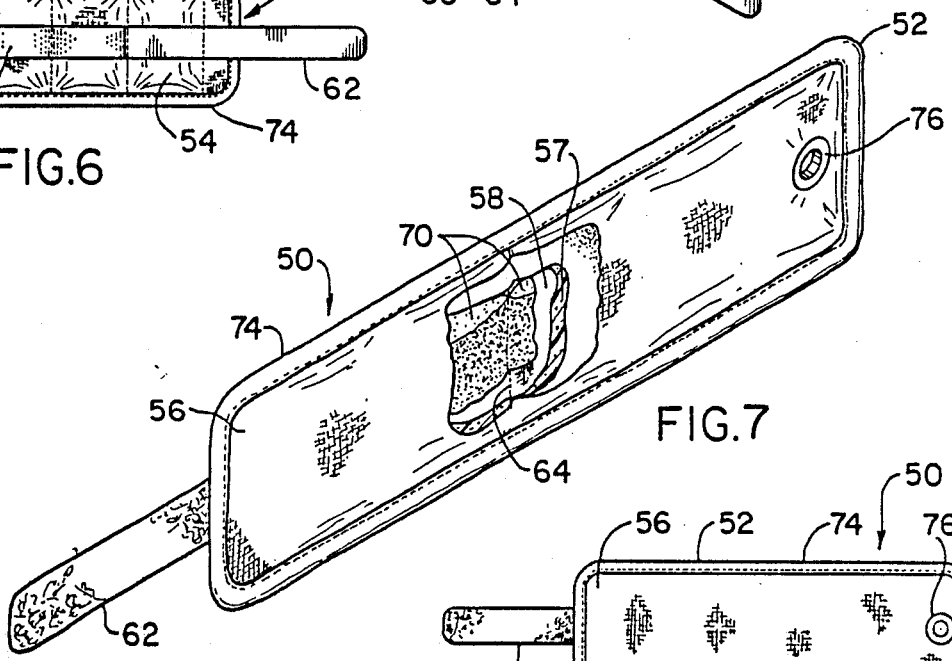
FIG.7
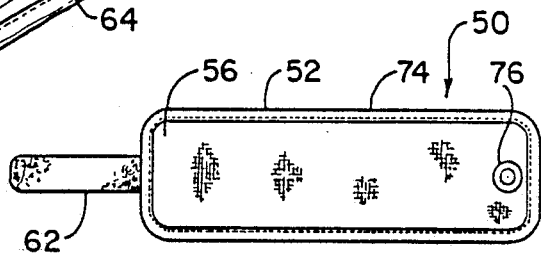
FIG.8

BODY EXERCISE DEVICE

This is a continuation of application Ser. No. 221,036, filed Jul. 18, 1988, now abandoned.

The present invention relates to exercise devices of the type typically in the form of a band which is wrapped around the wrist or ankle and provides, by virtue of bar weight or other weight components, a force against which the exercise is performed.

Heretofore, the use of bar weights were used in these prior art exercise bands, contributing to their ease of assembly and manufacture, and it was not deemed advantageous or necessary to use a radically different weight even though the contact of these bar weights against the wrist, ankle and even waist, is not particularly comfortable.

EXAMPLES OF PRIOR ART

U.S. Pat. No. 3,924,851 issued on Dec. 9. 1975 to Herbert Winston discloses a significant improvement over prior art exercise devices using individual metal bar-like weights by including a foam flap 24 which folds over the weights and thus into a position between the weights and the wearer's wrist, to thus "cushion" the otherwise uncomfortable contact of the bar weights against the bone structure of the wrist. That is, the bar weights are cylindrical and, of course, do not change shape, but the foam flap does have a variable shape, namely one that conforms to the underlying wrist bone structure, and in this manner significantly obviates discomfort due to different shapes in contact with each other.

While the noted Winston patent is an improvement over the cited prior art listed therein which has little or no provision for obviating the discomfort of the bar weights, it adds the expense of an external flap component to do so, and a somewhat more difficult sewing operation to embody this flap in the construction of the exercise device.

To obviate the discomfort of the bar weights, other prior art efforts have included, as disclosed in U.S. Pat. No. 2,011,362 issued on Aug. 13, 1935 to Haywand, the use of "padding 3 of cotton . . . to serve as a cushion (page 1, right column, at lines 39–41), as disclosed in U.S. Pat. No. 3,334,898 issued on Aug. 8, 1967 to McCrony et al., a rubber pad 32 (removable at the user's option) to cushion the feel of the weights 28 against the user's ankle, and as disclosed in U.S. Pat. No. 4,396,190 issued on Aug. 2, 1983 to Wilkenson, a construction in which interconnected weights 12 are wrapped in soft sponge 18.

It is also already known, but there is no specific literature reference convenient to cite, that particulate or sand can be used as an exercise weight component for the above noted bar weights used with or without cushioning. The sand however "packs" during use, and thus exhibits the same shortcomings of the bar weights.

This substitution of sand for bar weights as the force against which the exercise is performed, is an essential part of the within inventive exercise device, but the manner in which the sand is embodied therein is effective to overcome prior art shortcomings and otherwise provide noteworthy advantages. More specifically, without inhibiting the shifting of the sand so that it conforms to the bone structure shape of the user and thus allowing it to contribute to comfort during use, the particulate or sand is confined in packets and in individual pockets which are internally seamed, associated with sponge and foam pad components so as to obviate shifting to an extent that produces bulging and other possible sources of discomfort, nor is the sand allowed to "pack" in unyielding shapes that also may cause discomfort during use. The internal seaming obviates any external seaming which might press against the body of the user and result in discomfort.

The description of the invention which follows, together with the accompanying drawings, should not be construed as limiting the invention to the example shown and described, because those skilled in the art to which this invention appertains, will be able to devise other forms thereof within the ambit of the appended claims.

FIG. 3 is a perspective view showing the inner surface of the prior art device of FIG. 1 partly broken away to illustrate internal structural features.

FIG. 4 is a reduced scale elevational view of the outer surface of the prior art unit of FIG. 1.

FIG. 5 is a perspective view of the outer surface of the present invention in which the components are shown partly separated for detailed viewing.

FIG. 6 is a reduced scale elevational view of the surface shown in FIG. 5, but of the device fully assembled.

FIG. 7 is a perspective view showing the inner surface of the present invention which is partly broken away to show the inner construction.

FIG. 8 is a reduced scale elevational view of the surface shown in FIG. 7 but with the broken away panel intact, and showing a smooth, seamless outer surface without bulges;

Figure 9:
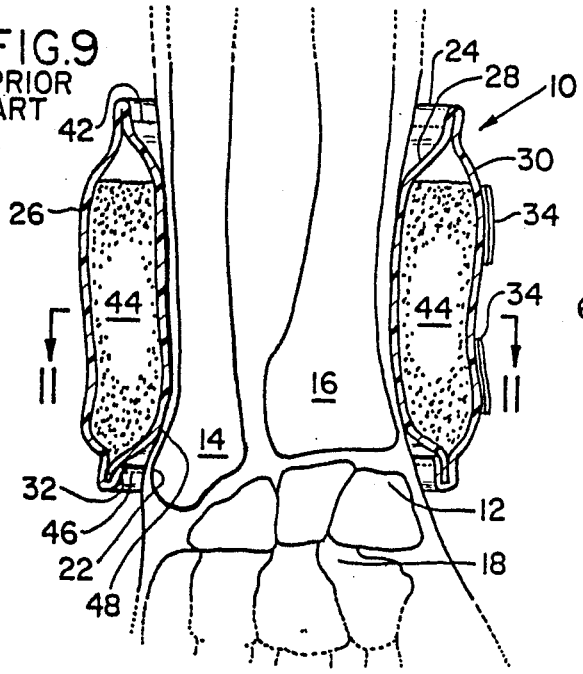
FIG.9 PRIOR ART
FIGS. 9 and 10 are views similar to FIGS. 1 and 2, but enlarged in scale and in section, showing the prior art device and the inventive device respectively, relative to the wearer's wrist and underlying bone structure.
Figure 10:
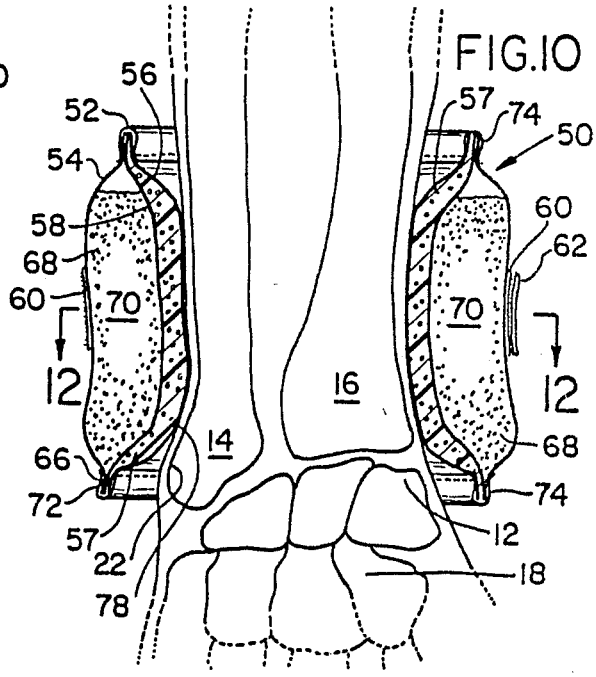
Figure 11:
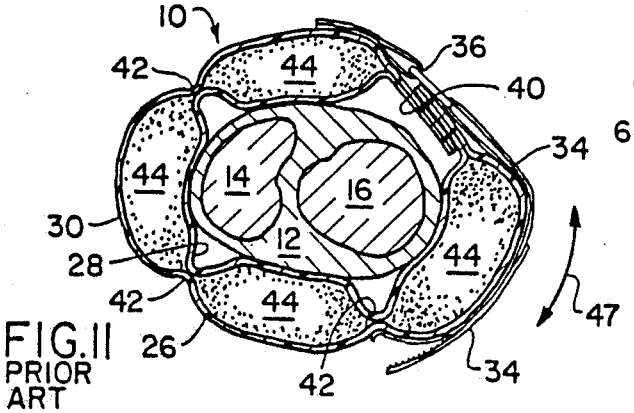
FIG.11 PRIOR ART
Figure 12:
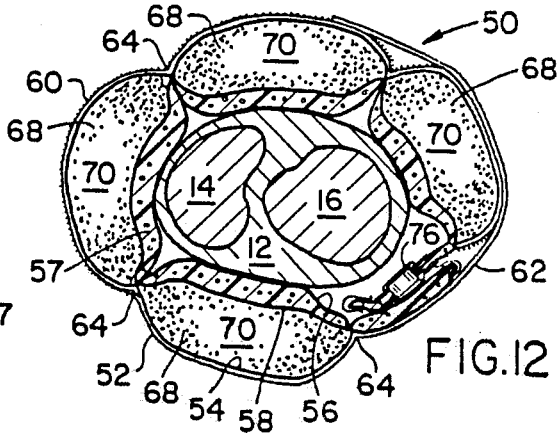

FIGS. 11 and 12 are sectional views respectively taken along lines 11—11 and 12—12 in FIGS. 9 and 10.

Figure 1:
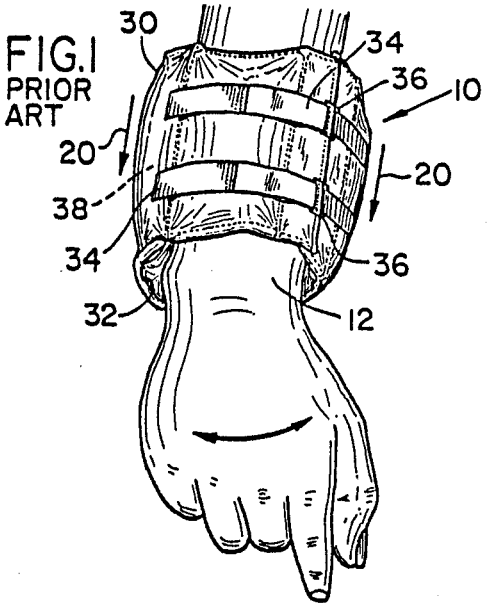
FIG.1 PRIOR ART
FIG. 1 is a perspective view of a prior art wrist exercise device in place about the wearer's wrist.
Figure 2:
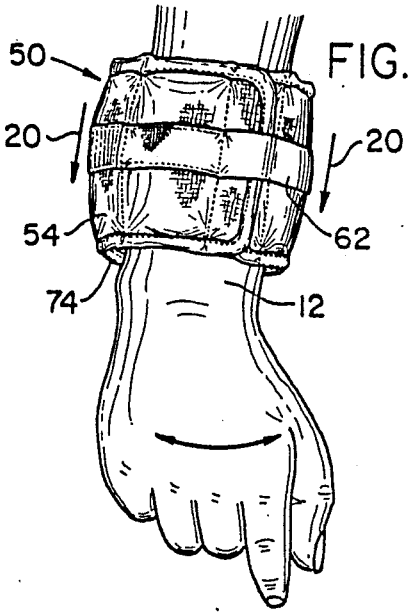
FIG. 2 is a view similar to FIG. 1 but, for comparison purposes, of the present inventive exercise device.

In FIG. 1 is shown a prior art device exercise device 10. In FIG. 2 is shown the exercise device 50 of the present invention. Both devices are shown in position, strapped about the wrist 12 of the user where they are intended to function as a force against which the exercise is performed and in this manner enhance muscular development of the user when exercising.

As seen in FIGS. 8 and 9 within the typical forearm and wrist 12 of the user, are bones known as the ulna 14, radius 16 and carpal bones 18. When the wearer exercises, gravity and centrifugal force 20 (FIGS. 1 and 2), due to swinging of the forearm about the elbow and shoulder, cause both devices 10 and 50 to move towards the hand. The distal ends of the ulna 14 and radius 16 are seen (FIGS. 9 and 10) to have a slight enlarging taper with a definite bulbous extension 22 at the end of the ulna 14. Because of the gradual taper of these bones, the lower interior surface of wrist weights 10 and 50 experience a wedging action against the skin of the wrist, particularly in the area of the bulbous extension 22.

Construction of the prior art device 10 will now be described with reference to FIGS. 3 and 4 in order to demonstrate how the construction thereof is only generally effective when used on the bone structure noted, whereas, as subsequently explained, the within inventive device is entirely effective.

To form the main body 24 of device 10 a sheet of Naugahyde 26 or the like, approximately 10×12¾ inches is folded to form an inner panel 28, an outer panel 30 and a final closure lip 32.

A pair of velcro straps 34 and a cooperating pair of loops 36 are positioned and sewn on the outer panel 30. Four weight pockets 38 and two end extensions are formed by stitchings 42 made in spaced relation across the main body 24. A measured amount of particulate matter 44, such as sand, metal shot or the like is introduced into each of the four pockets 38, followed by stitching 46 along the closure lip 32.

The construction of the improved inventive wrist exercise device 50 is next explained, and shown in conjunction with FIGS. 5–8.

As best seen in FIG. 5, the main body 52 of device 50 is comprised of three main fabric panels, namely a first outer panel 54, inner panel 58 and a second outer panel 56. In the stitching assembly of these panels, inner panel 58 is stitched only to the outer panel 54 and not to outer panel 56, so as to form pockets in the interior of the device in which there is no external seam in panel 56 which could result in discomfort to the user. Panel 56, as subsequently explained, is incorporated into the construction by the peripheral piping 74. In a preferred embodiment, the panels are 3¾×12½ inches in size and made of a finely woven nylon cloth made to have a textured surface. Additionally, a foam pad 57 of like size is located between panels 56 and 58.

A velcro hook strip 60 and a velcro mat strip 62 are located and sewn to outside panel 54. Five vertical stitchings 64 are then made between outside panel 54 and intermediate panel 58. A first longitudinal stitching 66 along one edge forms four pockets 68 for the reception of a measured amount of particulate matter 70 into each pocket. A second longitudinal run of stitching (not shown) along the open edge of pockets 68 closes the pockets to thereby contain the particulate matter 70 and complete the weighted sub-assembly. This sub-assembly is now joined to foam pad 57 and inner panel 56 in sandwich fashion, by peripheral stitching 72 (partly shown in FIG. 5). As a finishing margin and general reinforcement, piping 74 is sewn about the edge of main body 52. A grommet 76, to recieve a hook (not shown) for easy storage of device 50, completes the assembly. The mat surface of velcro strip 62 is made to engage hook surface of velcro strip 60 when device 50 is wrapped about the wrist 12 of the user.

FIGS. 9 and 11 should now be referred to and will provide a helpful comparison between the principal device 10 and the inventive device 50 shoown in like FIGS. 10 and 12.

In both devices 10 and 50 particulate matter 44 and 70 respectively, have a tendency to "pack" under the action of centrifugal force 20. This "packing" results in the particulate matter acting as a solid, hard body once it has settled and conformed to the shape of its container. In FIG. 9, is is to be specifically noted that under the action of force 20, a major portion of the weight of prior art device 10 bears against the area 48 of wrist 12. In contrast, a like point 78 on device 50 can be noted in FIG. 10 to be well padded by foam pad 57, as is the remaining skin contact surface within the encircling device 50.

Naugahyde 26, as a material, is impervious to moisture. When the user of device 10 perspires, surface 26 becomes a slippery allowing even more movement and impact to affect point 48 and give rise to discomfort on the wrist 12. When device 50 is used, however, like face 56 will absorb perspiration as it uses to advantage its sponge foam 57 component. Flexing of foam 57 also provides a degree of ventilation along the user's skin within the encircling device 50. Additionally, textured fabric 56 acts to minimize slippage.

As the user exercises, there may be a twisting action imposed on the device, as noted by the arrow 47 in FIG. 11. Inertia induced within and the sliding of device 10 will result in the device repositioning itself on the user's wrist 12. Since the particulate 44 may have already "packed", and thus assumed a shape, this applies additional forces to the user's skin as the device resists conforming to a new position on wrist 12. If, in contrast, device 50 is caused to rotate in a similar manner, pad 57 readily compensates for the new position, thereby minimizing trauma.

Particulate matter 44 and 70 is, of necessity, a dense material and when stored in a hot or cold atmosphere will assume a shape dictated by the storage temperature and tend to resist a change in this shape, despite the user's body temperature, at least during initial use. In device 50, however, foam 57 acts as a termal insulator between the wrist and particulate, thereby contributing to the user's comfort regardless of storage temperature. On the other hand, if device 10 is left in the sun and becomes hot, or is left outdoors in a cold climate and becomes cold to the touch, it will be quite uncomfortable to the user until heat transfer ensues. It is to be further noted that Naugahyde, or similar prior art construction material of device 50 is typically not adapted to remain flexible and comfortable through the likely temperatue range of use.

Figure 13:
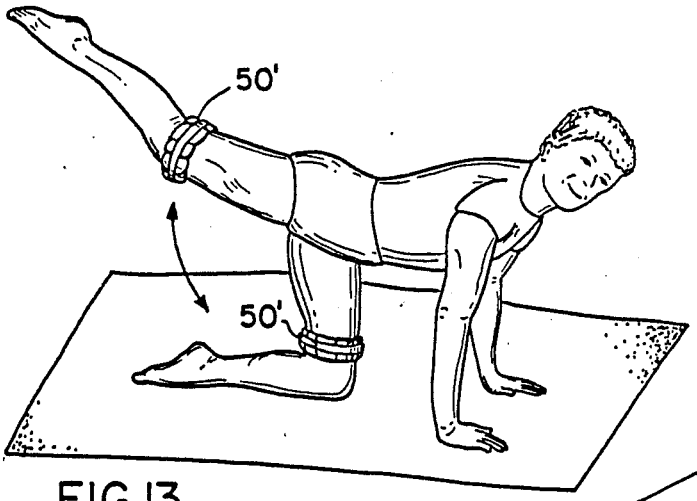
Figure 14:
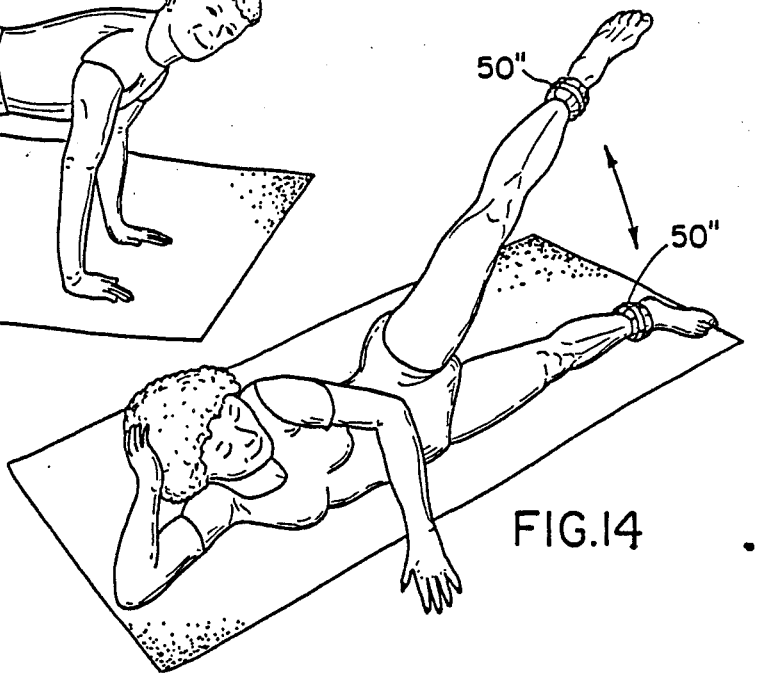
Figure 15:
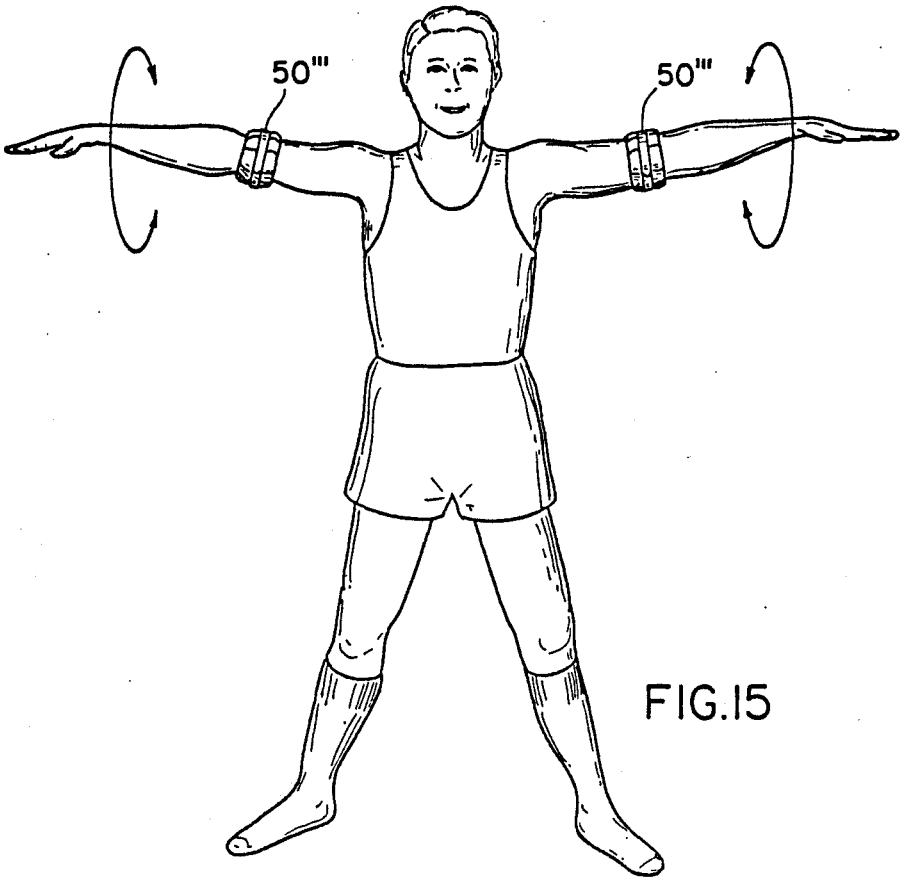

Although described as a wrist exercise weight, it will of course be understood that the within inventive device can be used in other body locations. An example is the application of the structural features of the invention to an ankle exercise device, instead of to an exercise device worn about the wrist. In either location, the described exercise device is an improvement over the prior art in the respects noted. More particularly, in FIGS. 13, 14 and 15 are shown further embodiments 50', 50'' and 50''Δ of the present invention adapted to be worn respectively on the lower thigh, ankle and upper arm just above the elbow. The dimensions and weight of each embodiment have been designed to suit its purpose and each embodiment features the aforedescribed well padded inner face and a seamless outer surface worn agains the body.

Each embodiment can be used in pairs as shown, or in combinations with other embodiments dependent upon the exercise program in progress. Multiple units on each limb may also be used.

While the particular exercise device herein shown and described in detail is fully capable of attaining the objects and providing the advantages hereinbefore stated, it is to be understood that is is merely illustrated of the presently preferred embodiment of the invention and that no limitations are intended to the detail of construction or design herein shown other than an defined in the appended claims.

What is claimed is:

1. An exercise device adapted to be worn about the user's limb, comprising first and second outer rectangular panels defining the outside and inside surfaces of the device, respectively; an inner panel located between said outer panels, each of said panels being of the same dimensions and being aligned with each other, said inner panel being affixed only to said first outer panel along a plurality of spaced parallel lines and along the longitudinal edges of said first outer and inner panels to define a series of pockets therebetween; a foam pad of the same dimension as said outer panels located between said inner and second outer panel; and a predetermined amount of particulate matter located within each of said pockets to create a weight-generating mass of predetermined magnitude, said joined first outer and inner panels being joined to said second outer panel and pad about the peripheries thereof by an overlying band embracing the aligned edges thereof; and a fastening strap affixed to said first outer panel and extending across each of said pockets and having a free end extending beyond the end of said first outer panel, said strap being mounted to said first outer panel along each of said parallel lines of affixation between said first outer panel and said inner panel, said fastening strap having first and second contiguous complementary engagement portions adapted to interengage when the device is wrapped about the user's limb.

* * * * *